US008706497B2

(12) United States Patent
Furuta et al.

(10) Patent No.: US 8,706,497 B2
(45) Date of Patent: Apr. 22, 2014

(54) SPEECH SIGNAL RESTORATION DEVICE AND SPEECH SIGNAL RESTORATION METHOD

(75) Inventors: Satoru Furuta, Tokyo (JP); Hirohisa Tasaki, Tokyo (JP)

(73) Assignee: Mitsubishi Electric Corporation, Tokyo (JP)

( * ) Notice: Subject to any disclaimer, the term of this patent is extended or adjusted under 35 U.S.C. 154(b) by 0 days.

(21) Appl. No.: 13/503,497

(22) PCT Filed: Oct. 22, 2010

(86) PCT No.: PCT/JP2010/006264
§ 371 (c)(1),
(2), (4) Date: Apr. 23, 2012

(87) PCT Pub. No.: WO2011/080855
PCT Pub. Date: Jul. 7, 2011

(65) Prior Publication Data

US 2012/0209611 A1 Aug. 16, 2012

(30) Foreign Application Priority Data

Dec. 28, 2009 (JP) ..... 2009-297147

(51) Int. Cl.
*G10L 13/00* (2006.01)

(52) U.S. Cl.
USPC ..... 704/268; 704/205; 704/207; 704/223; 704/258; 704/260; 704/266; 704/267; 704/270; 704/275; 704/500; 706/21; 381/94.1; 381/98

(58) Field of Classification Search
USPC ..... 704/205, 500, 270, 266, 258, 207, 223, 704/260, 267, 275; 381/94.1, 98; 706/21
See application file for complete search history.

(56) References Cited

U.S. PATENT DOCUMENTS 5,682,502 A * 10/1997 Ohtsuka et al. ..... 704/267
5,978,759 A * 11/1999 Tsushima et al. ..... 704/223

(Continued)

FOREIGN PATENT DOCUMENTS

JP 8-123484 5/1996
JP 8 248997 9/1996

(Continued)

OTHER PUBLICATIONS

Boll, S.F., "Suppression of Acoustic Noise in Speech Using Spectral Subtraction," IEEE Transactions on Acoustics, Speech and Signal Processing, vol. ASSP-27, No. 2, pp. 113-120, (Apr. 1979).

(Continued)

*Primary Examiner* — Michael Colucci
(74) *Attorney, Agent, or Firm* — Oblon, Spivak, McClelland, Maier & Neustadt, L.L.P.

(57) ABSTRACT

A synthesis filter 106 synthesizes a plurality of wide-band speech signals by combining wide-band phoneme signals and sound source signals from a speech signal code book 105, and a distortion evaluation unit 107 selects one of the wide-band speech signals with a minimum waveform distortion with respect to an up-sampled narrow-band speech signal output from a sampling conversion unit 101. A first bandpass filter 103 extracts a frequency component outside a narrow-band of the wide-band speech signal and a band synthesis unit 104 combines it with the up-sampled narrow-band speech signal.

8 Claims, 8 Drawing Sheets

(56) References Cited

U.S. PATENT DOCUMENTS

| | | | | |
|---|---|---|---|---|
| 6,081,781 | A * | 6/2000 | Tanaka et al. | 704/268 |
| 6,587,846 | B1 * | 7/2003 | LaMuth | 706/21 |
| 7,043,030 | B1 * | 5/2006 | Furuta | 381/94.1 |
| 8,121,847 | B2 * | 2/2012 | Klinke et al. | 704/500 |
| 8,145,492 | B2 * | 3/2012 | Fujita | 704/270 |
| 2002/0138253 | A1 * | 9/2002 | Kagoshima et al. | 704/207 |
| 2003/0055653 | A1 * | 3/2003 | Ishii et al. | 704/275 |
| 2003/0088418 | A1 * | 5/2003 | Kagoshima et al. | 704/258 |
| 2004/0019484 | A1 * | 1/2004 | Kobayashi et al. | 704/258 |
| 2004/0107102 | A1 * | 6/2004 | Chung et al. | 704/260 |
| 2005/0117756 | A1 * | 6/2005 | Shigyo et al. | 381/98 |
| 2005/0149330 | A1 * | 7/2005 | Katae | 704/267 |
| 2008/0033726 | A1 * | 2/2008 | Kudoh | 704/268 |
| 2008/0183473 | A1 * | 7/2008 | Nagano et al. | 704/258 |
| 2008/0201150 | A1 * | 8/2008 | Tamura et al. | 704/266 |
| 2009/0112580 | A1 * | 4/2009 | Hirabayashi et al. | 704/205 |

FOREIGN PATENT DOCUMENTS

| | | |
|---|---|---|
| JP | 10 124089 | 5/1998 |
| JP | 3230790 | 9/2001 |
| JP | 3243174 | 10/2001 |
| JP | 3454190 | 7/2003 |
| JP | 2007 72264 | 3/2007 |
| JP | 2008-52277 | 3/2008 |
| WO | 03 019533 | 3/2003 |

OTHER PUBLICATIONS

Lim, J.S., et al., "Enhancement and Bandwidth Compression of Noisy Speech," Proceedings of the IEEE, vol. 67, No. 12, pp. 1586-1604, (Dec. 1979).

International Search Report Issued Dec. 7, 2010 in PCT/JP10/06264 Filed Oct. 22, 2010.

Japanese Office Action issued Jul. 16, 2013, in Japan Patent Application No. 2011-547245 (with English translation).

* cited by examiner

SPEECH SIGNAL RESTORATION DEVICE AND SPEECH SIGNAL RESTORATION METHOD

TECHNICAL FIELD

The present invention relates to a speech signal restoration device and its method for restoring a wide-band speech signal from a speech signal whose frequency band is limited to a narrow band, and for restoring a speech signal with a deteriorated or partially collapsed band.

BACKGROUND ART

In analog telephones, the frequency band of a speech signal transmitted through a telephone circuit is limited to a narrow band such as 300-3400 Hz, for example. Thus, the quality of sound of a conventional telephone circuit is not good enough. In addition, in digital speech communication such as mobile telephones, since the band is limited as in the analog circuits because of rigid limits of bit rates, the quality of sound is not good enough as well.

Recently, however, with the development of speech compression technology (speech encoding technology), radio transmission of a wide-band speech signal (such as 50-7000 Hz) at a low bit rate has become possible. However, since both transmitting end and receiving end must support a corresponding wide-band speech encoding/decoding method, and base stations on both sides must be fully equipped with a network for wide-band encoding, it has only been put to practical use in part of business communication systems. To implement it in public telephone communication networks, it will not only entail an immense economic burden, but also take a lot of time before spreading.

Accordingly, a problem of the quality of sound in the conventional analog telephone circuit communication and digital speech communication remains unsolved.

Thus, Patent Documents 1 and 2 disclose, for example, a method of generating or restoring a wide-band signal from a narrow-band signal at a receiving side in a pseudo way. A frequency band extension device of the Patent Document 1 extracts a fundamental period of speech by calculating autocorrelation coefficients of a narrow-band speech signal and obtains a wide-band speech signal from the fundamental period. In addition, a wide-band speech signal restoration device of the Patent Document 2 encodes a narrow-band speech signal through an encoding method based on analysis by synthesis, and obtains a wide-band speech signal by carrying out zero filling (oversampling) to a sound source signal or speech signal obtained as a final result of the encoding.

PRIOR ART DOCUMENT

Patent Document

Patent Document 1: Japanese Patent No. 3243174 (pp. 3-5 and FIG. 1).

Patent Document 2: Japanese Patent No. 3230790 (pp. 3-4 and FIG. 1).

DISCLOSURE OF THE INVENTION

With the foregoing configurations, the conventional speech signal restoration devices have the following problems.

The frequency band extension device disclosed in the Patent Document 1 has to extract the fundamental period of the narrow-band speech signal. Although various techniques of extracting the fundamental period of speech have been disclosed, it is difficult to extract the fundamental period of a speech signal accurately. It becomes more difficult in a noisy environment.

The wide-band speech signal restoration device disclosed in the Patent Document 2 has an advantage of making it unnecessary to extract the fundamental period of the speech signal. However, as for the wide-band sound source signal generated, although it is analyzed and generated from the narrow band signal, it has aliasing components mixed because it is generated in a pseudo way through the zero filling processing (oversampling). Accordingly, it is not optimum as the wide-band speech signal (as a high-frequency signal, in particular) and has a problem of deteriorating the quality of sound.

The present invention is implemented to solve the foregoing problems. Therefore it is an object of the present invention to provide a speech signal restoration device and a speech signal restoration method capable of restoring high-quality speech signal.

A speech signal restoration device in accordance with the present invention includes: a synthesis filter for generating a plurality of speech signals by combining phoneme signals and sound source signals; a distortion evaluation unit for evaluating, using a prescribed distortion scale, a waveform distortion of each of the plurality of speech signals the synthesis filter generates with respect to a comparison target signal having a frequency component of at least part of a frequency band of the speech signals the synthesis filter generates, and for selecting one of the plurality of speech signals according to the evaluation result; and a restored speech signal generating unit for generating a restored speech signal using the speech signal the distortion evaluation unit selects.

A speech signal restoration method in accordance with the present invention includes: a synthesis filter step of generating a plurality of speech signals by combining phoneme signals and sound source signals; a distortion evaluation step of evaluating, using a prescribed distortion scale, a waveform distortion of each of the plurality of speech signals the synthesis filter step generates with respect to a comparison target signal having a frequency component of at least part of a frequency band of the speech signals the synthesis filter step generates, and of selecting one of the plurality of speech signals according to the evaluation result; and a restored speech signal generating step of generating a restored speech signal using the speech signal the distortion evaluation step selects.

According to the present invention, since it is configured in such a manner as to generate the plurality of speech signals by combining the phoneme signals and sound source signals, to evaluate the waveform distortion of each of them with respect to the comparison target signal using the prescribed distortion scale, and to generate the restored speech signal by selecting one of the speech signals according to the evaluation result, it can provide a speech signal restoration device and speech signal restoration method capable of restoring the high-quality comparison target signal from the comparison target signal that lacks the frequency component of any given frequency band owing to the band limitation or noise suppression, for example.

EMBODIMENTS FOR CARRYING OUT THE INVENTION

The best mode for carrying out the invention will now be described in detail with reference to the accompanying drawings.

Embodiment 1

In the present embodiment 1, an example of a speech signal restoration device will be described which is used for improving the quality of sound of a car navigation system, a speech communication system such as a mobile telephone and an intercom, a hands-free telephonic communication system, a video conferencing system and a supervisory system to which a speech communication, speech storage or speech recognition system is introduced, and for improving a recognition rate of the speech recognition system, and which is used for generating a wide-band speech signal from a speech signal whose frequency band is limited to a narrow band because of passing through a transmission path like a telephone circuit.

Figure 1:
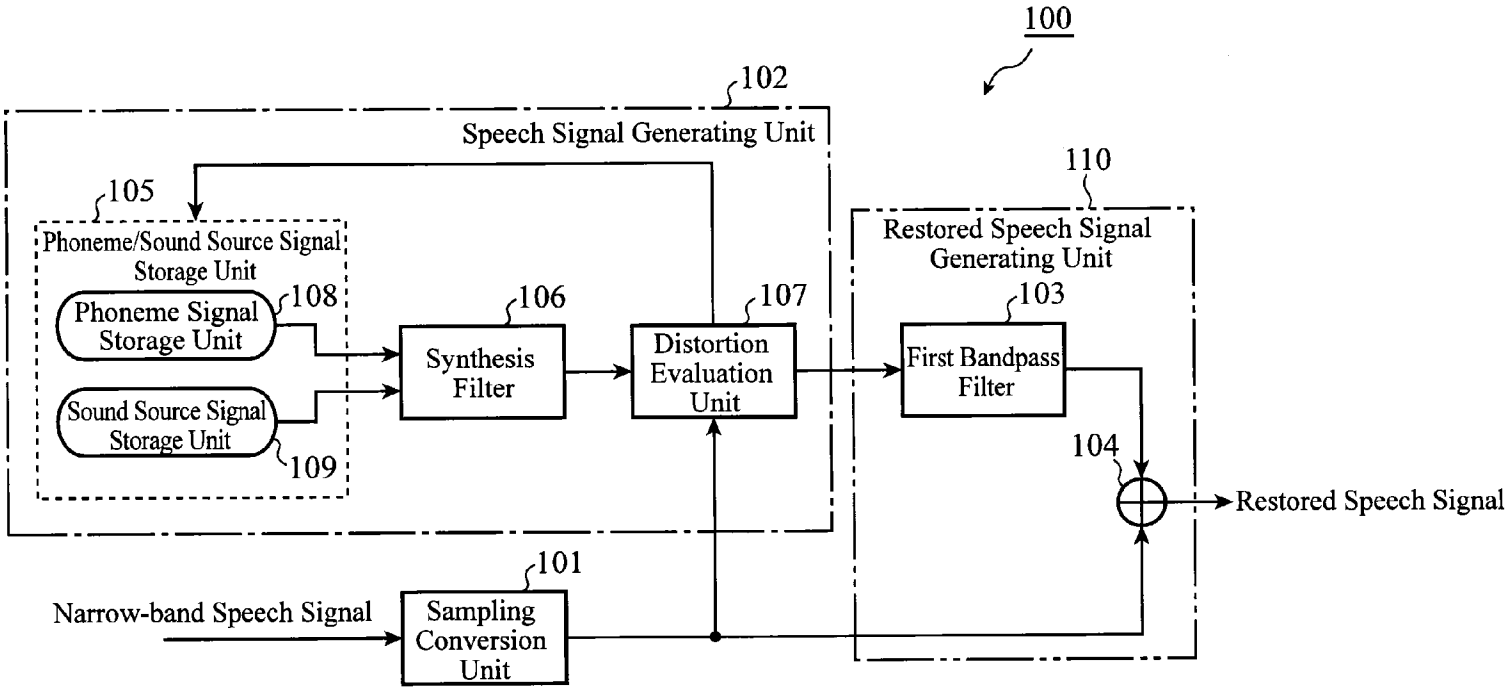
FIG. 1 is a block diagram showing a configuration of a speech signal restoration device 100 of an embodiment 1 in accordance with the present invention.

FIG. 1 is a block diagram showing an entire configuration of a speech signal restoration device 100 of the present embodiment 1.

In FIG. 1, the speech signal restoration device 100 comprises a sampling conversion unit 101, a speech signal generating unit 102, and a restored speech signal generating unit 110. The speech signal generating unit 102 comprises a phoneme/sound source signal storage unit 105 including a phoneme signal storage unit 108 and a sound source signal storage unit 109, a synthesis filter 106 and a distortion evaluation unit 107. In addition, the restored speech signal generating unit 110 comprises a first bandpass filter 103 and a band synthesis unit 104.

Figure 2:
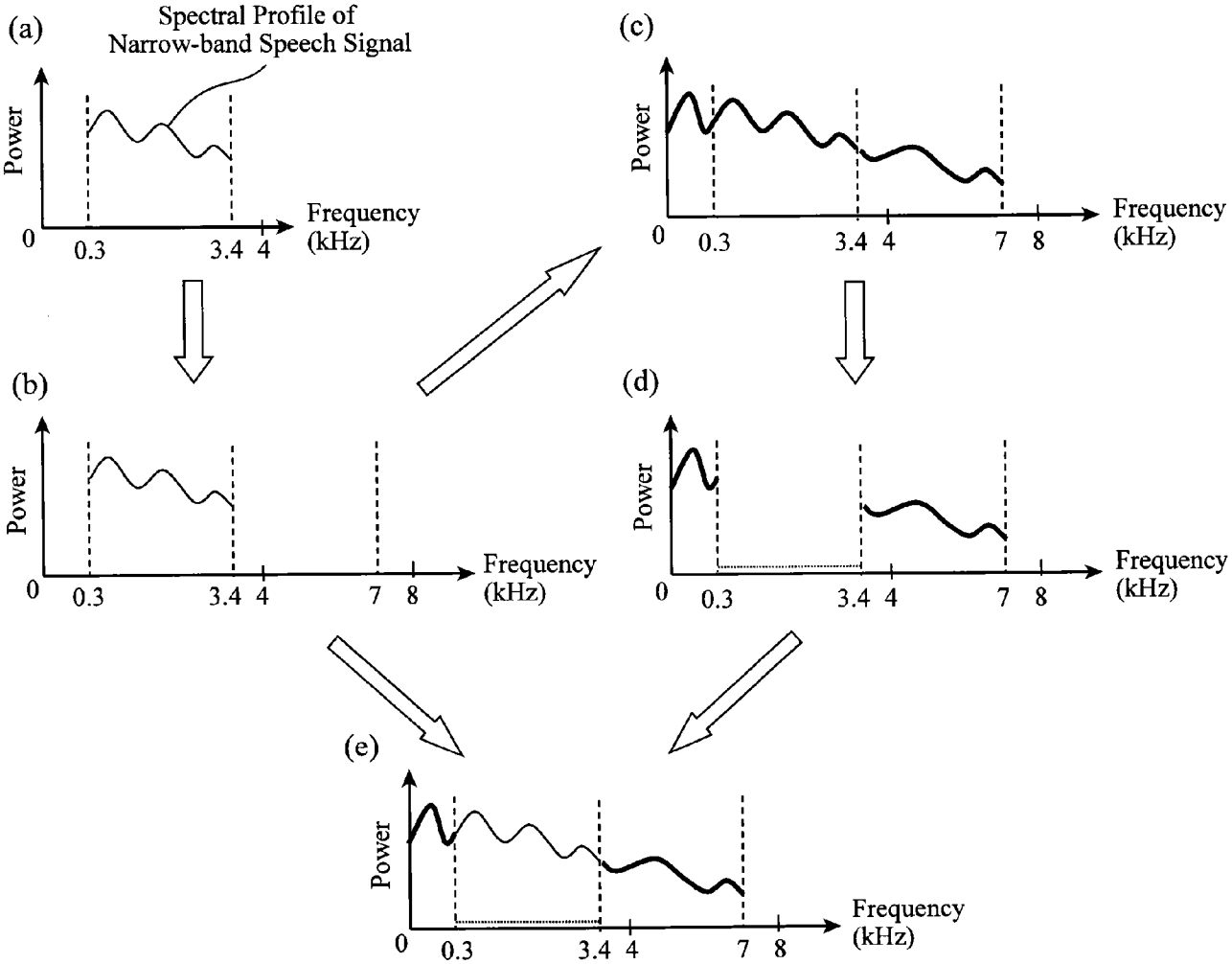
FIG. 2 is a set of graphs schematically showing a speech signal the speech signal restoration device 100 of the embodiment 1 in accordance with the present invention generates.

FIG. 2 schematically shows a speech signal generated by the configuration of the embodiment 1. FIG. 2(*a*) shows a narrow-band speech signal (comparison target signal) input to the sampling conversion unit 101. FIG. 2(*b*) shows an up-sampled narrow-band speech signal (comparison target signal passing through the sampling conversion) the sampling conversion unit 101 outputs. FIG. 2(*c*) shows a wide-band speech signal with minimum distortion, which the distortion evaluation unit 107 selects from a plurality of wide-band speech signals (speech signals) the synthesis filter 106 generates. FIG. 2(*d*) shows a signal obtained by extracting a low-frequency component and a high-frequency component from the wide-band speech signal, which is the output of the first bandpass filter 103. FIG. 2(*e*) shows a restored speech signal which is an output result of the speech signal restoration device 100. In addition, arrows in FIG. 2 represent the order of processing, the vertical axis of each graph shows power and the horizontal axis shows a frequency.

The principle of operation of the speech signal restoration device 100 will be described below with reference to FIG. 1 and FIG. 2.

First, a signal such as speech and music, which is acquired with a microphone or the like not shown undergoes A/D (analog/digital) conversion, followed by being sampled at a prescribed sampling frequency (8 kHz, for example) and by being divided into frame units (10 ms, for example), and further undergoes band limitation (300-3400 Hz, for example) and is input to the speech signal restoration device 100 of the present embodiment 1 as a narrow-band speech signal. Incidentally, the present embodiment 1 will be described on the assumption that the frequency band of the finally obtained wide-band restored speech signal is 50-7000 Hz.

The sampling conversion unit 101 carries out up-sampling to 16 kHz, for example, of the input narrow-band speech signal, removes an aliasing signal through a low-pass filter, and outputs as the up-sampled narrow-band speech signal.

In the speech signal generating unit 102, the synthesis filter 106 generates a plurality of wide-band speech signals using phoneme signals stored in the phoneme signal storage unit 108 and sound source signals stored in the sound source signal storage unit 109, and the distortion evaluation unit 107 calculates their waveform distortions with respect to the up-sampled narrow-band speech signal according to a prescribed distortion scale, and selects and outputs the wide-band speech signal that will minimize the distortion. Incidentally, the speech signal generating unit 102 can have the same configuration as a decoding method in a CELP (Code-Excited Linear Prediction) encoding system. In such a case, a phoneme code is stored in the phoneme signal storage unit 108 and a sound source code is stored in the sound source signal storage unit 109.

The phoneme signal storage unit 108 has a configuration that has the power or gain of the phoneme signals besides the phoneme signals, stores extensive diverse phoneme signals in a storage such as a memory in order to be able to represent phonemic forms (spectral patterns) of various wide-band speech signals, and supplies the phoneme signals to the synthesis filter 106 in response to an instruction of the distortion evaluation unit 107 which will be described later. These phoneme signals can be obtained from wide-band speech signals (with a band of 50-7000 Hz, for example) using a publicly known technique such as linear prediction analysis. Incidentally, as for the spectral patterns, they can be expressed using a spectral signal itself or using an acoustic parameter form such as LSP (Line Spectrum Pair) parameters and cepstrum, and they are suitably converted in advance so that they are applicable to the filter coefficients of the synthesis filter 106. Furthermore, to reduce the amount of memory, the phoneme signals obtained can be compressed by a publicly known technique such as scalar quantization and vector quantization.

The sound source signal storage unit 109 has a configuration that has the power or gain of the sound source signals besides the sound source signals, stores extensive diverse sound source signals in a storage such as a memory in order to be able to represent sound source signal forms (pulse trains) of various wide-band speech signals in the same manner as the phoneme signal storage unit 108, and supplies the sound source signals to the synthesis filter 106 in response to an instruction of the distortion evaluation unit 107 which will be described later. These sound source signals can be obtained by learning by the CELP technique using the wide-band speech signals (with a band of 50-7000 Hz, for example) and the phoneme signals described above. In addition, to reduce the amount of memory, the sound source signals obtained can be compressed by a publicly known technique such as scalar quantization and vector quantization, or the sound source signals can be expressed in a prescribed model such as making multipulses and an ACELP (Algebraic Code-Excited Linear Prediction) system. In addition, a structure is also possible which also has an adaptive sound source code book generated from past sound source signals such as a VSELP (Vector Sum Excited Linear Prediction) encoding system.

Incidentally, the synthesis filter 106 can perform synthesis after adjusting the power or gain of the phoneme signals and the power or gain of the sound source signals, respectively. With this configuration, since it can generate a plurality of wide-band speech signals even from a single phoneme signal and a single sound source signal, the amount of memory of the phoneme signal storage unit 108 and sound source signal storage unit 109 can be reduced.

The distortion evaluation unit 107 estimates the waveform distortions of the wide-band speech signals the synthesis filter 106 outputs with respect to the up-sampled narrow-band speech signal the sampling conversion unit 101 outputs. In this case, it is assumed that the frequency band (prescribed frequency band) in which the distortion is estimated is limited to only the range of the narrow-band speech signal, that is, 300-3400 Hz in this example. To estimate the waveform distortion within the frequency band of the narrow-band speech signal, after carrying out filter processing of both the wide-band speech signal and up-sampled narrow-band speech signal using an FIR (Finite Impulse Response) filter with band-pass characteristics of 300-3400 Hz, for example, an evaluation method can be employed which uses the average waveform distortion given by the following expression or uses the Euclidean distance.

$$E_t = \frac{1}{N}\sum_{n=0}^{N-1}\{s(n) - u(n)\}^2 \tag{1}$$

where s(n) and u(n) are the wide-band speech signal and up-sampled narrow-band speech signal after passing through the FIR filter processing, and N is the number of samples of the speech signal waveform (160 samples in the case of 16 kHz sampling). Incidentally, when not restoring a low-frequency range not greater than 300 Hz, it is possible to perform down-sampling of the wide-band speech signal to the frequency (8 kHz) of the narrow-band speech signal without using the FIR filter, and to carry out the distortion evaluation of the down-sampled wide-band speech signal with respect to the narrow-band speech signal before the up-sampling. Incidentally, although the distortion evaluation unit 107 carries out the filter processing using the FIR filter in the foregoing description, an IIR (Infinite Impulse Response) filter can also be used, for example, as long as it can carry out the distortion evaluation appropriately.

The distortion evaluation unit 107 can also carry out the distortion evaluation not on the time axis but on the frequency axis. For example, it converts both the wide-band speech signal and up-sampled narrow-band speech signal to a spectral region using a 256 point FFT (Fast Fourier Transform) after applying zero filling and windowing on them, and estimates the distortion in terms of the sum total of differences between them on the power spectrum as the following expression. In this case, it is not necessary to execute the filter processing with the band-pass characteristics as in the evaluation on the time axis.

$$E_f = \sum_{f=FL}^{FH}\{S(f) - U(f)\} \tag{2}$$

where S(f) and U(f) are the power spectrum component of the wide-band speech signal and the power spectrum component of the up-sampled narrow-band speech signal, and FL and FH are a spectral component number at 300 Hz and 3400 Hz, respectively.

The distortion evaluation unit 107 successively instructs the phoneme signal storage unit 108 and sound source signal storage unit 109 to output a combination of the spectral pattern and sound source signal, causes the synthesis filter 106 to generate the wide-band speech signals, and calculates the distortions according to the foregoing Expression (1) or (2). Then, it selects the wide-band speech signal with the minimum distortion and supplies it to the first bandpass filter 103. Incidentally, the distortion evaluation unit 107 can apply the auditory weighting processing, which is normally used in a CELP speech encoding system, to both the wide-band speech signal and up-sampled narrow-band speech signal, and then calculate the distortion. In addition, it is not always necessary for the distortion evaluation unit 107 to select the wide-band speech signal with the minimum distortion. It can select the wide-band speech signal with the second lowest distortion. Alternatively, a configuration is possible which sets a tolerable range of the distortion and selects the wide-band speech signal with the distortion within that range, excluding the subsequent processing of the synthesis filter 106 and distortion evaluation unit 107, thereby reducing the number of times of the processing.

The first bandpass filter 103 extracts frequency components outside the band of the narrow-band speech signal from the wide-band speech signal, and supplies them to the band synthesis unit 104. More specifically, it extracts the low-frequency component not higher than 300 Hz and the high-frequency component not lower than 3400 Hz in the present embodiment 1. To extract the low-frequency component and high-frequency component, an FIR filter, IIR filter or the like can be used. As general characteristics of a speech signal, a harmonic structure of the low-frequency range is likely to appear in the high-frequency range in the same manner, and conversely if the harmonic structure is also observed in the high-frequency range, it is likely to appear in the low-frequency range in the same manner. Thus, since the low-frequency and high-frequency ranges have a strong cross-correlation, the optimum restored speech signal can be constructed by obtaining the low-frequency component and high-frequency component which are extracted through the first bandpass filter 103 from the wide-band speech signal which is generated in such a manner as to have the minimum distortion with respect to the narrow-band speech signal.

The band synthesis unit 104 adds the low-frequency component and high-frequency component of the wide-band speech signal the first bandpass filter 103 outputs to the up-sampled narrow-band speech signal the sampling conversion unit 101 outputs to restore the wide-band speech signal, and outputs the resultant signal as the restored speech signal As described above, according to the present embodiment 1, the speech signal restoration device 100 for converting the narrow-band speech signal whose band is limited to a narrow band to the wide-band speech signal including the narrow band is configured in such a manner as to comprise the sampling conversion unit 101 for sampling-converting the narrow-band speech signal in such a manner as to match to the wide band; the synthesis filter 106 for generating a plurality of wide-band speech signals by combining the phoneme signals and sound source signals which have wide-band frequency components and are stored in the phoneme/sound source signal storage unit 105; the distortion evaluation unit 107 for estimating with the prescribed distortion scale the waveform distortions of the plurality of wide-band speech signals the synthesis filter 106 generates with respect to the up-sampled narrow-band speech signal the sampling conversion unit 101 obtains by the sampling-conversion, and for selecting the wide-band speech signal with the minimum distortion from the estimation result; the first bandpass filter 103 for extracting the frequency components outside the narrow band from the wide-band speech signal the distortion evaluation unit 107 selects; and the band synthesis unit 104 for combining the frequency components the first bandpass filter 103 extracts with the up-sampled narrow-band speech signal passing through the sampling-conversion of the sampling conversion unit 101. In this way, since it obtains the low-frequency component and high-frequency component to be used for the speech signal restoration from the wide-band speech signal generated in such a manner as to minimize the distortion of the narrow-band speech signal, it can restore high quality wide-band speech signal.

In addition, according to the present embodiment 1, since it does not need to extract the fundamental period of speech and has no degradation due to extraction error of the fundamental period, it can restore a high quality wide-band speech signal even in a noisy environment in which the analysis of the fundamental period of the speech is difficult.

Besides, according to the present embodiment 1, since it does not execute nonlinear processing such as zero filling and full-wave rectification processing, which will deteriorate the sound source signals, it can restore a high quality wide-band speech signal.

Furthermore, according to the present embodiment 1, since it obtains the low-frequency component and high-frequency component to be used for the speech signal restoration from the wide-band speech signal which is generated in such a manner as to minimize the distortion of the narrow-band speech signal, it can connect the narrow-band speech signal with the low-frequency component (or the high-frequency component with the narrow-band speech signal) smoothly theoretically, thereby being able to restore the high quality wide-band speech signal without using interpolation processing such as power correction at the band synthesis.

Incidentally, when the distortion evaluation result of the distortion evaluation unit 107 is very small, the speech signal restoration device 100 of the foregoing embodiment 1 can omit the processing of the first bandpass filter 103 and band synthesis unit 104, and can directly output the wide-band speech signal the distortion evaluation unit 107 outputs as the restored speech signal.

In addition, although the foregoing embodiment 1 is configured in such a manner that as to the narrow-band speech signal lacking in both the low-frequency and high-frequency components, it restores both the low-frequency and high-frequency components, the configuration is not limited to it. For example, it goes without saying that the narrow-band speech signal lacking in at least one of the low-frequency, middle frequency and high-frequency bands can also be restored. In this way, the speech signal restoration device 100 can restore a frequency band with the same band as the wide-band speech signal from the narrow-band speech signal if the narrow-band speech signal includes a frequency band having at least part of the frequency band of the wide-band speech signal the synthesis filter 106 generates.

Embodiment 2

Figure 3:
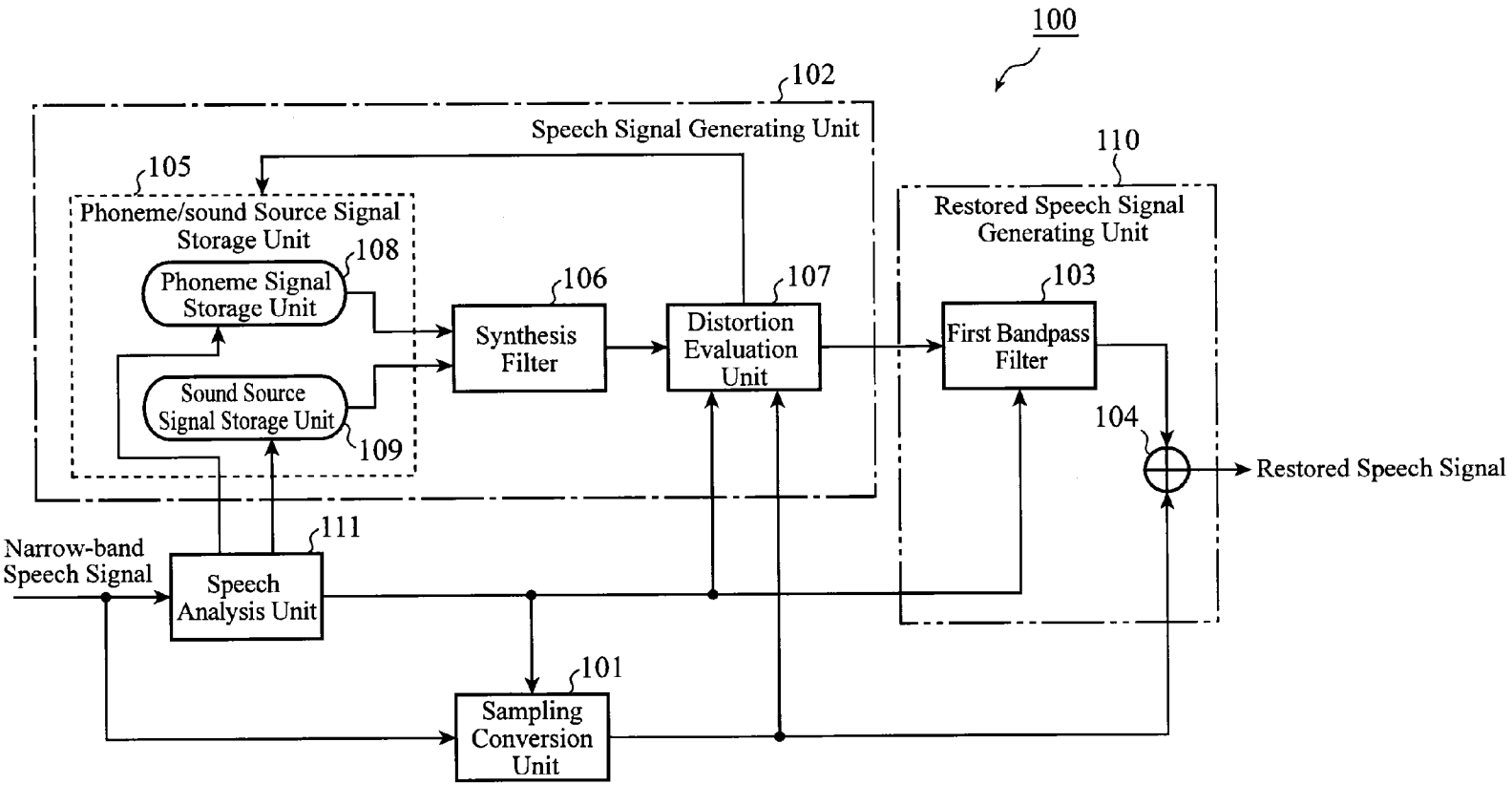
FIG. 3 is a block diagram showing a configuration of a speech signal restoration device 100 of an embodiment 2 in accordance with the present invention.

As a variation of the foregoing embodiment 1, a configuration is also possible which uses the analysis result of the narrow-band speech signal as auxiliary information for generating a wide-band speech signal. FIG. 3 is a block diagram showing the whole configuration of the speech signal restoration device 100 of the present embodiment 2. It has a configuration that includes a speech analysis unit 111 newly added to the speech signal restoration device 100 shown in FIG. 1. As for the remaining components, those corresponding to the components of FIG. 1 are designated by the same reference numerals and their detailed description will be omitted here.

The speech analysis unit 111 analyzes acoustic features of the input narrow-band speech signal by a publicly known technique such as linear prediction analysis, extracts phoneme signals and sound source signals of the narrow-band speech signal, and supplies them to the phoneme signal storage unit 108 and sound source signal storage unit 109. Here, as the phoneme signals, although LSP parameters with good interpolation characteristics are preferable, some other parameters can also be used. In addition, as for the sound source signals, the speech analysis unit 111 can comprise an inverse filter having as its filter coefficients the phoneme signals which are the analysis result, and can use the residual signal obtained by applying filter processing on the narrow-band speech signal as the sound source signals.

The phoneme/sound source signal storage unit 105 uses the phoneme signals and sound source signals of the narrow-band speech signal supplied from the speech analysis unit 111 as the auxiliary information of the phoneme signal storage unit 108 and sound source signal storage unit 109. As the use of the auxiliary information, for example, the phoneme signal storage unit 108 can remove the part of 300-3400 Hz from the phoneme signals of the wide-band speech signal, and can assign the phoneme signals of the narrow-band speech signal to the part removed. Assigning the phoneme signals of the narrow-band speech signal makes it possible to obtain the phoneme signals of the wide-band speech signal that is more approximate to the narrow-band speech signal. In addition, the phoneme signal storage unit 108 can carry out preliminary selection which conducts the distortion evaluation of the wide-band speech signal with respect to the phoneme signals of the narrow-band speech signal on spectra, for example, and supplies the synthesis filter 106 with only the phoneme signals of the wide-band speech signal with a small distortion. The preliminary selection of the phoneme signals enables the synthesis filter 106 and distortion evaluation unit 107 to reduce the number of times of their processing.

As for the use of the auxiliary information, the sound source signal storage unit 109 can add the sound source signals of the narrow-band speech signal to the wide-band speech signal in the same manner as the phoneme signal storage unit 108, for example, or can use it as information for the preliminary selection. Adding the sound source signals of the narrow-band speech signal makes it possible to obtain the sound source signals of the wide-band speech signal more approximate to the narrow-band speech signal. In addition, carrying out the preliminary selection of the sound source signal enables the synthesis filter 106 and distortion evaluation unit 107 to reduce the number of times of their processing.

As described above, according to the present embodiment 2, the speech signal restoration device 100 is configured in such a manner that it comprises the speech analysis unit 111 for generating the auxiliary information by carrying out the acoustic analysis of the narrow-band speech signal whose band is limited to a narrow band, and that the synthesis filter 106, using the auxiliary information the speech analysis unit 111 generates, combines the plurality of phoneme signals and the plurality of sound source signals having wide-band frequency components the phoneme/sound source signal storage unit 105 stores, thereby generating a plurality of wide-band speech signals. Accordingly, using the analysis result of the narrow-band speech signal as the auxiliary information enables obtaining the wide-band speech signal more approximate to the narrow-band speech signal, and thus restoring the higher quality wide-band speech signal.

In addition, according to the present embodiment 2, since it can carry out the preliminary selection of the phoneme signals and sound source signals using the analysis result of the narrow-band speech signal as the auxiliary information when generating the wide-band speech signal, it can reduce the amount of processing while maintaining the high quality.

Incidentally, in the present embodiment 2, although the processing of the speech analysis unit 111 is carried out before input to the sampling conversion unit 101, it can be performed after the processing of the sampling conversion unit 101. In this case, it carries out the speech analysis of the up-sampled narrow-band speech signal.

In addition, as for the input narrow-band speech signal, the speech analysis unit 111 can conduct frequency analysis of the speech signal and noise signal, for example, and generate the auxiliary information that designates the frequency band in which the ratio of the speech signal spectrum power to the noise signal spectrum power (a signal-to-noise ratio which is referred to as an S/N ration from now on) is high. With the configuration, the sampling conversion unit 101 carries out the sampling conversion of the frequency component in the frequency band (prescribed frequency band) designated by the auxiliary information in the narrow-band speech signal, and the distortion evaluation unit 107 carries out the distortion evaluation of the plurality of wide-band speech signals with respect to the up-sampled narrow-band speech signal between the frequency components in the frequency band designated by the auxiliary information. Furthermore, the first bandpass filter 103 extracts a frequency component outside the frequency band designated by the auxiliary information from the wide-band speech signal selected by the distortion evaluation unit 107, and the band synthesis unit 104 combines it to the up-sampled narrow-band speech signal of the frequency band. Accordingly, the distortion evaluation unit 107 carries out the distortion evaluation only in the frequency band designated by the auxiliary information rather than in the entire frequency band of the narrow-band speech signal, thereby being able to reduce the amount of the processing.

Embodiment 3

Figure 4:
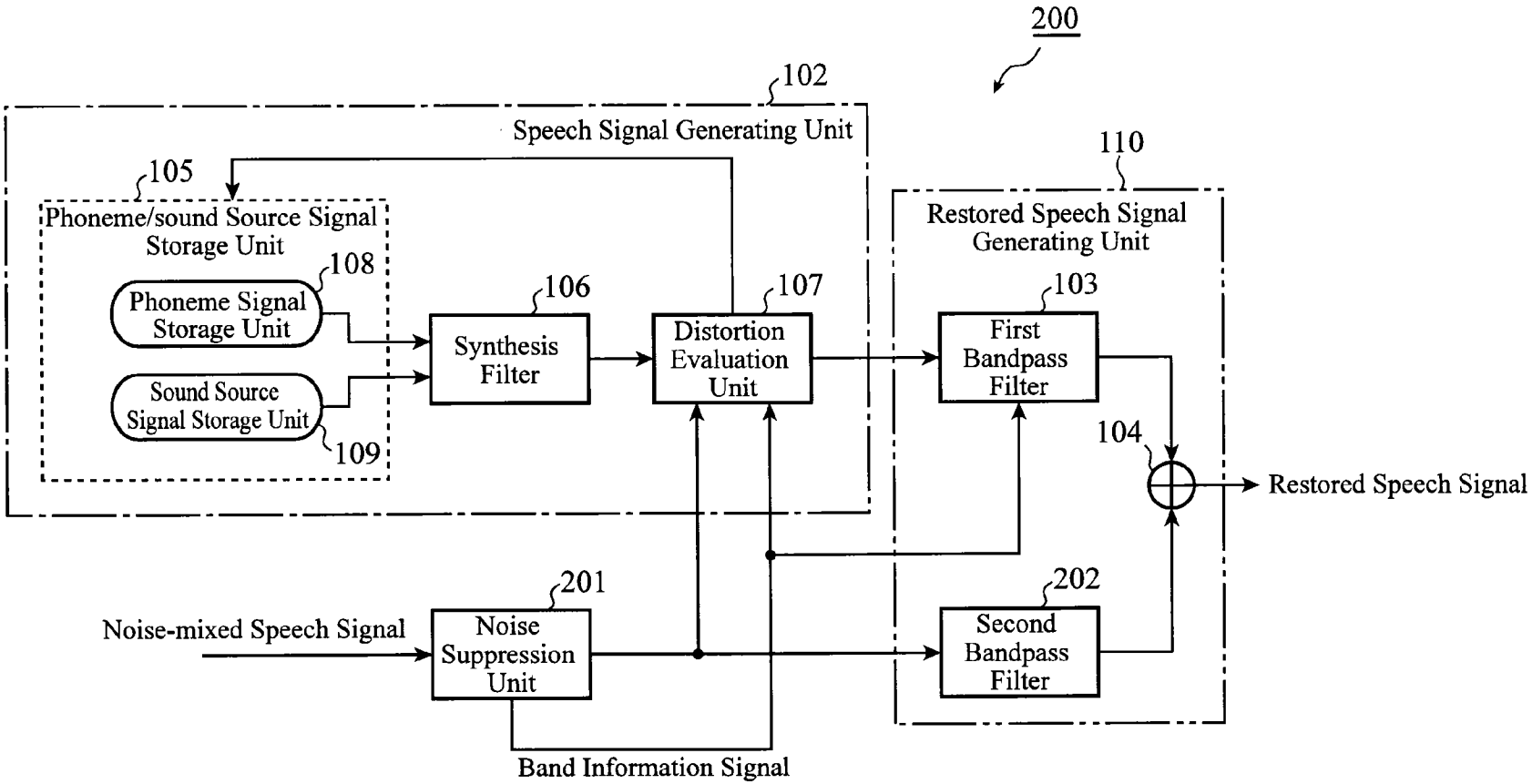
FIG. 4 is a block diagram showing a configuration of a speech signal restoration device 200 of an embodiment 3 in accordance with the present invention.

In the foregoing embodiment 2, although the speech signal restoration device 100 is described for generating the wide-band speech signal from the speech signal whose frequency band is limited to the narrow band, the present embodiment 3 configures, by modifying and applying the speech signal restoration device 100, a speech signal restoration device 200 for restoring a speech signal with a deteriorated or partially collapsed frequency band because of noise suppression or speech compression. FIG. 4 is a block diagram showing the entire configuration of the speech signal restoration device 200 of the present embodiment 3. It has a configuration that newly adds a noise suppression unit 201 and a second bandpass filter 202 to the speech signal restoration device 100 shown in FIG. 1. As for the remaining components, those corresponding to the components of FIG. 1 are designated by the same reference numerals and their detailed description will be omitted here.

Incidentally, for the sake of brevity, it is assumed in the present embodiment 3 that the frequency band of an input noise-mixed speech signal is 0-4000 Hz, that the mixed noise is vehicle running noise, and that the noise is mixed into a 0-500 Hz band. Here, the phoneme/sound source signal storage unit 105, synthesis filter 106 and distortion evaluation unit 107 in the speech signal generating unit 102, the first bandpass filter 103 and the second bandpass filter 202 perform operation in accordance with the frequency band of 0-4000 Hz, and retain the phoneme signals and sound source signals. Incidentally, it goes without saying that these conditions can be altered when applied to a real system.

Figure 5:
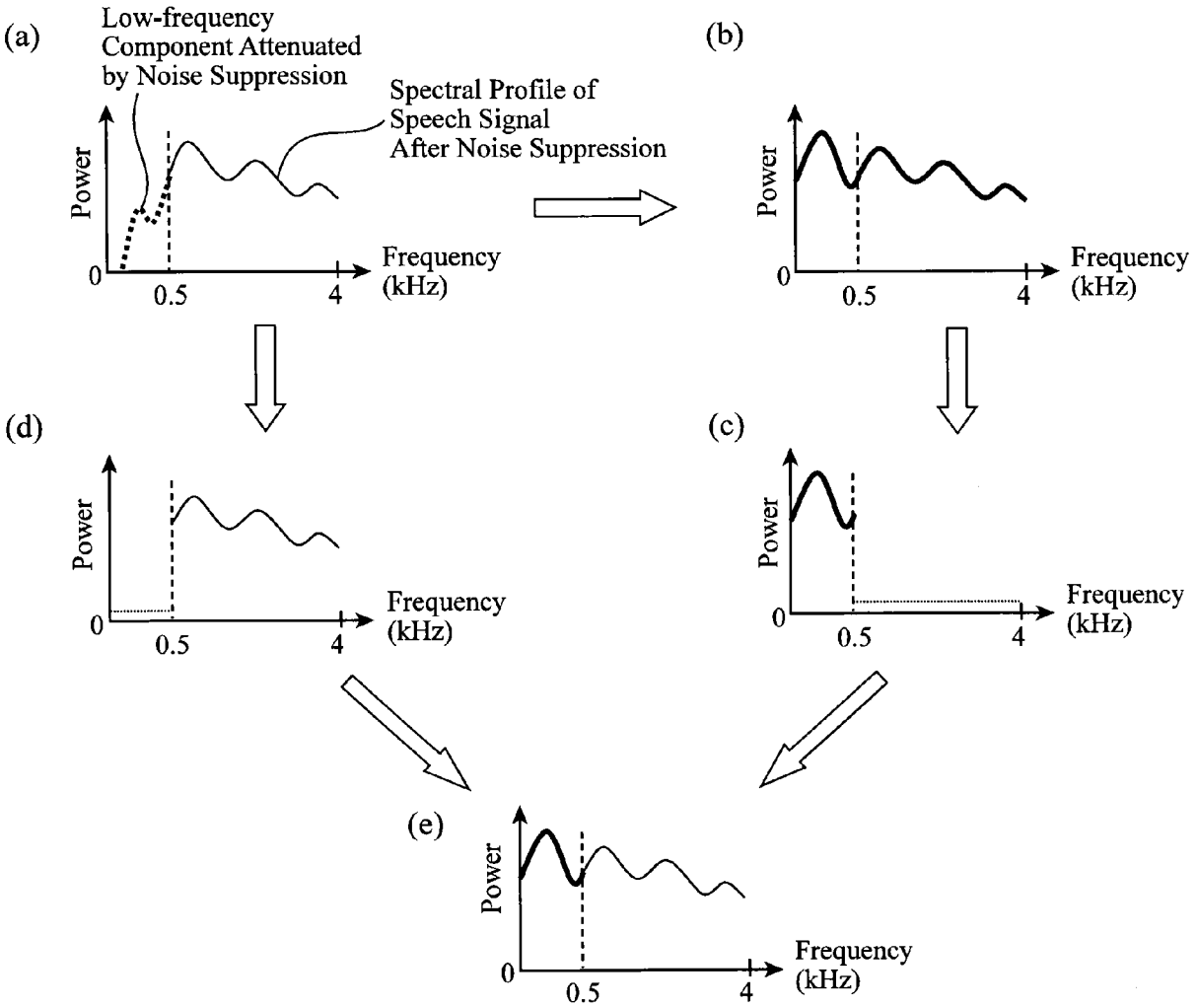
FIG. 5 is a set of graphs schematically showing a speech signal the speech signal restoration device 200 of the embodiment 3 in accordance with the present invention generates.

FIG. 5 is a diagram schematically showing a speech signal generated by the configuration of the present embodiment 3. FIG. 5(*a*) shows a noise-suppressed speech signal (comparison target signal) the noise suppression unit 201 outputs. FIG. 5(*b*) shows a wide-band speech signal which the distortion evaluation unit 107 selects from a plurality of wide-band speech signals (speech signals) the synthesis filter 106 generates and which has the minimum distortion with respect to the noise-suppressed speech signal. FIG. 5(*c*) shows a signal obtained by extracting a low-frequency component from the wide-band speech signal, which is the output of the first bandpass filter 103. FIG. 5(*d*) shows a high-frequency component of the noise-suppressed speech signal the second bandpass filter 202 outputs. FIG. 5(*e*) shows a restored speech signal, which is an output result of the speech signal restoration device 200. In addition, arrows in FIG. 5 show the order of the processing, and the vertical axis of each graph shows power and the horizontal axis shows a frequency.

The principle of operation of the speech signal restoration device 200 will be described below with reference to FIG. 4 and FIG. 5.

The noise suppression unit 201 receives the noise-mixed speech signal into which noise is mixed, and supplies the noise-suppressed speech signal to the distortion evaluation unit 107 and second bandpass filter 202. In addition, the noise suppression unit 201 outputs a band information signal that designates a low/high range division frequency for separating into the low-frequency band of 0-500 Hz and high-frequency band of 500-4000 Hz, which are used for the distortion evaluation in the post-stage distortion evaluation unit 107 and first bandpass filter 103. Incidentally, although the present embodiment 3 fixes the band information signal at 500 Hz, it can also carry out the analysis of the mode of the input noise-mixed speech signal such as frequency analysis of the speech signal and the noise signal, and can set the band information signal at the frequency at which the noise signal spectrum power exceeds the speech signal spectrum power (the frequency at which the SN ratio crosses 0 dB on the spectra). In addition, since the frequency varies every moment in accordance with the input noise-mixed speech signal and the mode of the noise, the frequency can be altered every frame of 10 ms, for example.

Here, as a noise suppression technique in the noise suppression unit 201, publicly known methods can be used such as a technique based on spectral subtraction disclosed in Steven F. Boll, "Suppression of acoustic noise in speech using spectral subtraction", IEEE Trans. ASSP, Vol. ASSP-27, No. 2, April 1979, and a technique of spectral amplitude suppression that gives the amount of attenuation to each spectrum component based on the SN ratio of each spectrum component disclosed in J. S. Lim and A. V. Oppenheim, "Enhancement and Bandwidth Compression of Noisy Speech", Proc. of the IEEE, vol. 67, pp. 1586-1604, December 1979, as well as a technique that combines the spectral subtraction and the spectral amplitude suppression (Japanese Patent No. 3454190, for example).

As in the foregoing embodiment 1, in the speech signal generating unit 102, the synthesis filter 106 generates a plurality of wide-band speech signals using the phoneme signals stored in the phoneme signal storage unit 108 and the sound source signals stored in the sound source signal storage unit 109, and the distortion evaluation unit 107 estimates their waveform distortions with respect to the noise-suppressed speech signal passing through the noise suppression according to the prescribed distortion scale, and selects and outputs the wide-band speech signal with the waveform distortion meeting any given condition.

The distortion evaluation unit 107 limits the frequency band (prescribed frequency band), in which it estimates the distortion when evaluating the waveform distortion, to a range higher than the frequency the band information signal designates, and limits to 500-4000 Hz in the example. To estimate the waveform distortion in this range, a technique similar to that used in the foregoing embodiment 1 can be employed, for example. The distortion evaluation unit 107 successively issues an instruction to cause the phoneme signal storage unit 108 and sound source signal storage unit 109 to output combinations of the spectral patterns and sound source signals, causes the synthesis filter 106 to generate a plurality of wide-band speech signals, selects the wide-band speech signal with the minimum waveform distortion, for example, and supplies it to the first bandpass filter 103.

The first bandpass filter 103 extracts the low-frequency component with a frequency not greater than the low/high range division frequency the band information signal indicates from the wide-band speech signal generated by the distortion evaluation unit 107, and supplies it to the band synthesis unit 104. To extract the low-frequency component by the first bandpass filter 103, an FIR filter, IIR filter or the like can be used as in the embodiment 1. As general characteristics of a speech signal, a harmonic structure of a low-frequency range is likely to appear in a high-frequency range in the same manner, and conversely if the harmonic structure is observed in the high-frequency range, it is likely to appear in the low-frequency range in the same manner. Thus, since the low-frequency and high-frequency ranges have a strong cross-correlation, it is conceivable that the optimum restored speech signal can be constructed by obtaining the low-frequency component which is extracted through the first bandpass filter 103 from the wide-band speech signal which is generated in such a manner as to have the minimum distortion with respect to the noise-suppressed speech signal.

The second bandpass filter 202 carries out the inverse operation to that of the foregoing first bandpass filter 103. More specifically, it extracts from the noise-suppressed speech signal the high-frequency component with a frequency range not less than the low/high range division frequency the band information signal indicates, and supplies it to the band synthesis unit 104. To extract the high-frequency component by the second bandpass filter 202, an FIR filter, IIR filter or the like can be used in the same manner as the first bandpass filter 103.

The band synthesis unit 104 restores the speech signal by adding the low-frequency component of the wide-band speech signal the first bandpass filter 103 outputs and the high-frequency component of the noise-suppressed speech signal the second bandpass filter 202 outputs, and outputs the sum as the restored speech signal.

According to the present embodiment 3, the speech signal restoration device 200, which restores the deteriorated or partially collapsed noise-suppressed speech signal through the noise suppression of the noise-mixed speech signal by the noise suppression unit 201 and generates the restored speech signal, is configured in such a manner as to comprise the synthesis filter 106 for generating a plurality of wide-band speech signals by combining the phoneme signals and sound source signals the phoneme/sound source signal storage unit 105 stores; the distortion evaluation unit 107 for estimating the waveform distortions of the plurality of wide-band speech signals the synthesis filter 106 generates with respect to the noise-suppressed speech signal, and for selecting the wide-band speech signal with the minimum distortion on the basis of the evaluation result using the prescribed distortion scale; the first bandpass filter 103 for extracting the frequency component with the deteriorated or partially collapsed frequency band from the wide-band speech signal the distortion evaluation unit 107 selects; the second bandpass filter 202 for extracting the frequency component outside the deteriorated or partially collapsed frequency band from the noise-suppressed speech signal; and the band synthesis unit 104 for combining the frequency component the first bandpass filter 103 extracts and the frequency component the second bandpass filter 202 extracts. In this way, since it obtains the low-frequency component to be used for the speech signal restoration from the speech signal generated in such a manner as to minimize the distortion with respect to the noise-suppressed speech signal, it can restore the high quality speech signal.

In addition, according to the present embodiment 3, since it does not need to extract the fundamental period of speech and has no degradation due to the extraction error of the fundamental period, it can restore a high quality wide-band speech signal even in a noisy environment in which the analysis of the fundamental period of the speech is difficult.

Furthermore, according to the present embodiment 3, since it obtains the low-frequency component to be used for the speech signal restoration from the speech signal which is generated in such a manner as to minimize the distortion with respect to the noise-suppressed speech signal, it can smoothly connect the high-frequency component of the noise-suppressed speech signal and the generated low-frequency component theoretically, thereby being able to restore the high quality speech signal without using interpolation processing such as power correction at the band synthesis.

Incidentally, when the distortion evaluation result of the distortion evaluation unit 107 is very small, the speech signal restoration device 200 of the foregoing embodiment 3 can omit the processing of the first bandpass filter 103, second bandpass filter 202 and band synthesis unit 104, and can directly output the wide-band speech signal the distortion evaluation unit 107 outputs as the restored speech signal.

In addition, although the foregoing embodiment 3 is configured in such a manner as to restore the low-frequency component for the noise-suppressed signal whose low-frequency range is deteriorated or partially collapsed, the configuration is not limited to it. For example, a configuration is also possible which restores, for the noise-suppressed speech signal that has one of the low-frequency component and high-frequency component or both of them deteriorated or partially collapsed, the frequency components of these bands. Alternatively, a configuration is also possible which restores the frequency component of an intermediate band of 800-1000 Hz, for example, in response to the band information signal the noise suppression unit 201 outputs. As a state in which the intermediate band is deteriorated or partially collapsed, a case is conceivable in which local band noise such as wind noise occurring during high-speed driving of the vehicle is mixed into the speech signal. In this way, as long as the noise-suppressed speech signal has a frequency band of at least part of the frequency band of the wide-band speech signal the synthesis filter 106 generates, the embodiment 3 can restore the frequency component with the residual frequency band of the noise-suppressed speech signal in the same manner as the foregoing embodiments 1 and 2.

Embodiment 4

As a variation of the foregoing embodiment 3, a configuration is also possible which uses the analysis result of the noise-suppressed speech signal as auxiliary information for generating a wide-band speech signal in the same manner as the foregoing embodiment 2. More specifically, the speech analysis unit 111 as shown in FIG. 3 is added to the speech signal restoration device 200 of the foregoing embodiment 3, analyzes acoustic features as to the noise-suppressed speech signal supplied from the noise suppression unit 201, extracts the phoneme signals and sound source signals of the noise-suppressed speech signal, and supplies them to the phoneme signal storage unit 108 and sound source signal storage unit 109.

According to the present embodiment 4, since the speech signal restoration device 200 is configured in such a manner that it comprises the speech analysis unit 111 for carrying out acoustic analysis of the noise-suppressed speech signal and for generating the auxiliary information, and that the synthesis filter 106 generates a plurality of wide-band speech signals by combining the phoneme signals and sound source signals the phoneme/sound source signal storage unit 105 stores using the auxiliary information the speech analysis unit 111 generates. Thus using the analysis result of the noise-suppressed speech signal as the auxiliary information enables obtaining the wide-band speech signal more approximate to the noise-suppressed speech signal, thereby being able to restore a higher quality speech signal.

In addition, according to the present embodiment 4, when generating the wide-band speech signals, since it can carry out preliminary selection of the phoneme signals and sound source signals using the analysis result of the noise-suppressed speech signal as the auxiliary information, it can reduce the amount of processing while maintaining the high quality.

Embodiment 5

Although the foregoing embodiment 3 divides the speech signal into two parts of the low-frequency and high-frequency ranges in accordance with the band information signal and causes the distortion evaluation processing to estimate only the distortion in the high-frequency range, a configuration is also possible which assigns weights to a part of the low-frequency component, followed by using it as a target of the distortion evaluation, or which carries out weighting in according with the frequency characteristics of the noise signal, followed by performing distortion evaluation. Incidentally, since the speech signal restoration device of the present embodiment 5 has the same configuration as the speech signal restoration device 200 shown in FIG. 4 on the drawing, the following description will be made with the help of FIG. 4.

Figure 6:
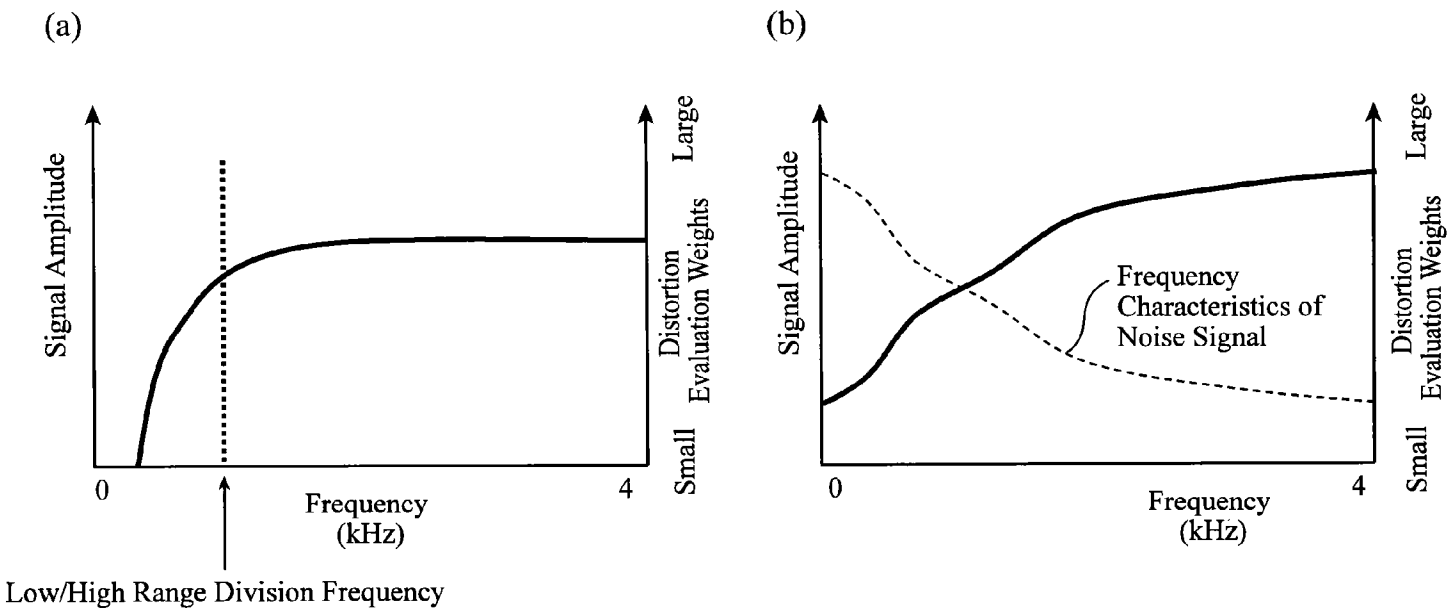
FIG. 6 is a set of graphs schematically showing distortion evaluation processing of the distortion evaluation unit 107 of a speech signal restoration device 200 of an embodiment 5 in accordance with the present invention.

FIG. 6 shows an example of weighting coefficients used for the distortion evaluation of the distortion evaluation unit 107: FIG. 6(*a*) shows a case that employs part of the low-frequency component as an evaluation target as well; and FIG. 6(*b*) shows a case that uses the inverse characteristics of the frequency characteristics of the noise signal as weighting coefficients. In each graph in FIG. 6, the vertical axis shows amplitude and distortion evaluation weights and the horizontal axis shows frequency. Incidentally, as a method of reflecting the weighting coefficients in the distortion evaluation of the distortion evaluation unit 107, a method can be conceived, for example, which performs convolution of the weighting coefficients with the filter coefficients, or which multiplies the power spectrum components by the weighting coefficients. In addition, as the characteristics of the first bandpass filter 103 and second bandpass filter 202, characteristics are possible which separate them at the low-frequency range and high-frequency range in the same manner as the foregoing embodiment 3, or filter characteristics are possible which shows the frequency characteristics of the weighting coefficients of FIG. 6(*a*).

A reason for making the low-frequency range the evaluation target as shown in FIG. 6(*a*) is that although the low-frequency component undergoes noise suppression, its speech component is not lost completely, and that adding the component to the evaluation enables improving the quality of the wide-band speech signal generated. In addition, the distortion evaluation performed using the inverse characteristics of the frequency characteristics of noise as shown in FIG. 6(*b*) can improve the quality of the wide-band speech signal generated because it can assign weights to the high-frequency range with a comparatively high SN ratio.

According to the present embodiment 5, the distortion evaluation unit 107 is configured in such a manner as to evaluate the waveform distortion using the distortion scale to which weights are assigned on the frequency axis. Thus, the distortion evaluation carried out by assigning weights to part of the low-frequency component can improve the quality of the speech signal generated and can restore the higher quality speech signal.

In addition, according to the present embodiment 5, since it carries out the distortion evaluation by weighting in accordance with the inverse characteristics of the frequency characteristics of noise, it can improve the quality of the speech signal generated and can restore the higher quality speech signal.

Incidentally, although the weighting of the distortion evaluation is performed for the restoration of the noise-suppressed speech signal in the foregoing embodiment 5, it is also applicable to the restoration of the wide-band speech signal from the narrow-band speech signal by the speech signal restoration device 100 of the foregoing embodiments 1 and 2 in the same manner.

In addition, although the foregoing embodiments 1-5 describe a case of the telephone speech as an example of the narrow-band speech signal, they are not limited to the telephone speech. For example, they are also applicable to the high-frequency range generating processing of a signal whose high-frequency range is cut off by an acoustic signal encoding technique such as MP3 (MPEG Audio Layer-3). In addition, the frequency band of the wide-band speech signal is not limited to 50-7000 Hz. For example, they are applicable to a wider band such as 50-16000 Hz.

Figure 7:
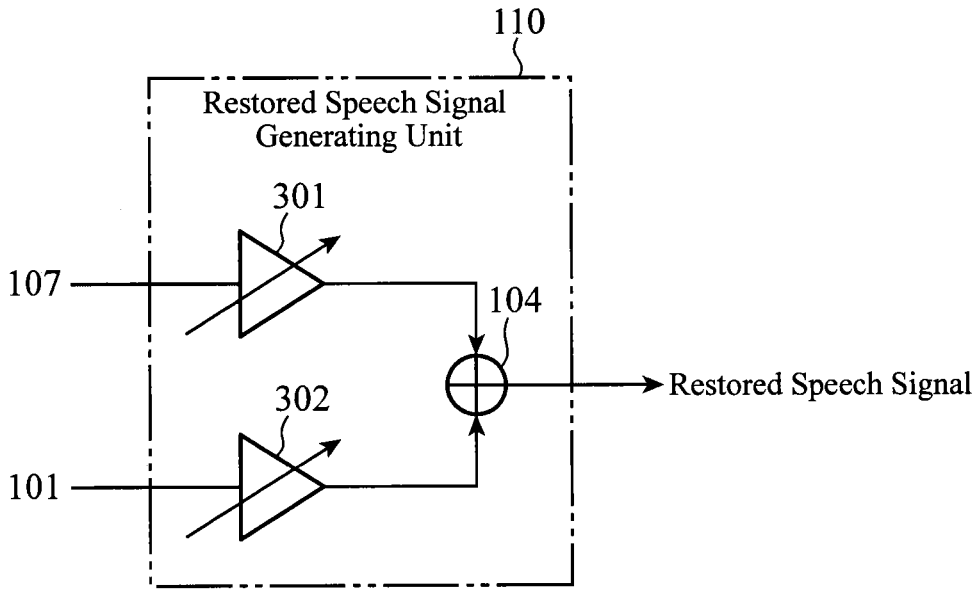
FIG. 7 is a block diagram showing a variation of the restored speech signal generating unit 110 shown in FIG. 1.
Figure 8:
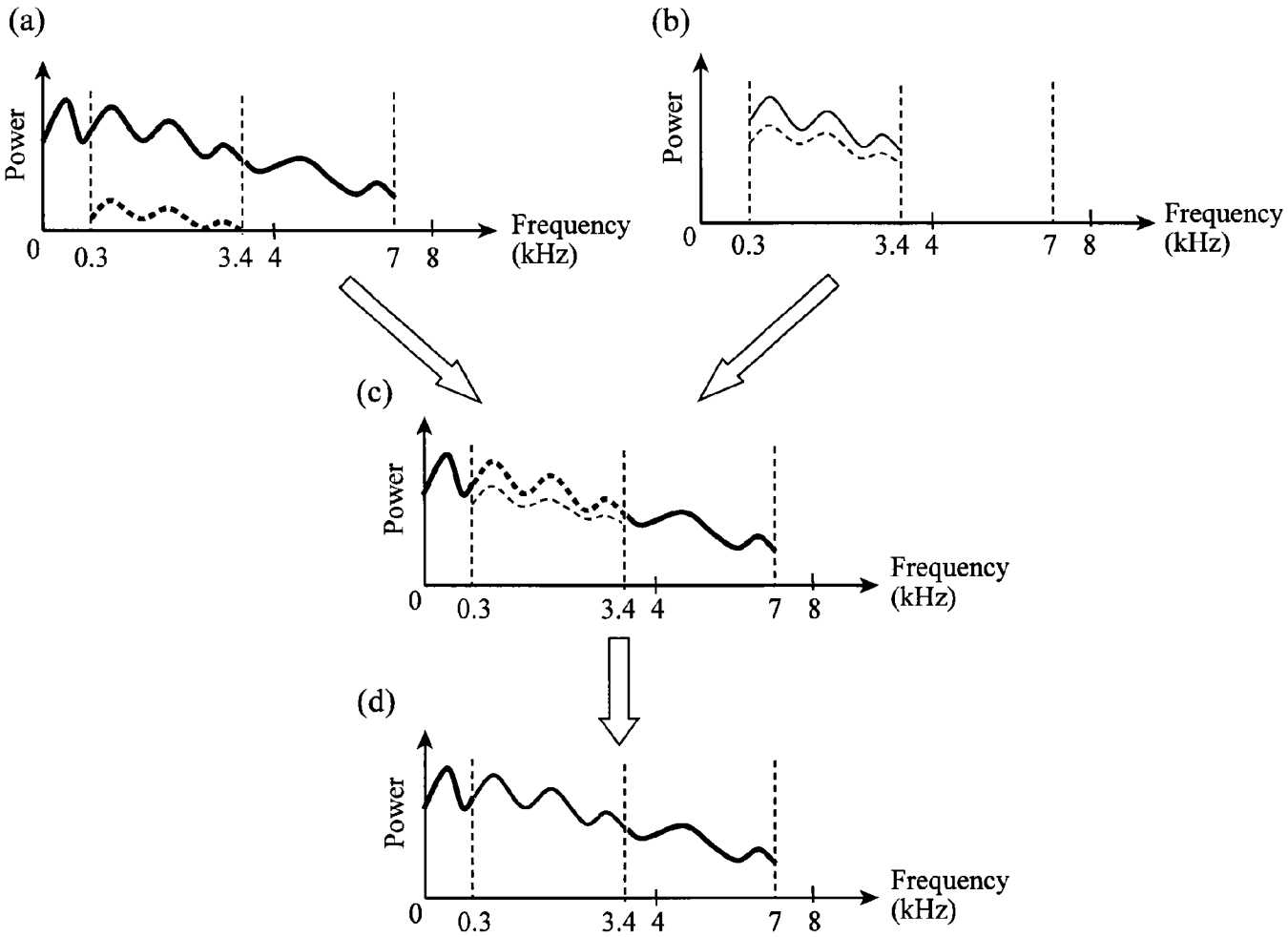
FIG. 8 is a set of graphs schematically showing a speech signal the restored speech signal generating unit 110 shown in FIG. 7 generates.

In addition, although the restored speech signal generating unit 110 shown in the foregoing embodiments 1-5 has a configuration of cutting out a particular frequency band from the speech signal through the bandpass filter and of generating the restored speech signal by combining it with another speech signal through the band synthesis unit, it is not limited to the configuration. For example, a configuration is also possible which generates the restored speech signal by performing weighted addition of two types of the speech signals input to the restored speech signal generating unit 110. FIG. 7 shows an example in which the restored speech signal generating unit 110 with the configuration is applied to the speech signal restoration device 100 of the foregoing embodiment 1, and FIG. 8 schematically shows the restored speech signal. Incidentally, arrows in FIG. 8 represent the order of processing, the vertical axis of each graph shows power and the horizontal axis shows a frequency.

As shown in FIG. 7, the restored speech signal generating unit 110 comprises two weight adjusting units 301 and 302 newly. The weight adjusting unit 301 adjusts the weight (gain) of the wide-band speech signal output from the distortion evaluation unit 107 to 0.2 (broken line shown in FIG. 8(*a*)), for example, and the weight adjusting unit 302 adjusts the weight (gain) of the up-sampled speech signal output from the sampling conversion unit 101 to 0.8 (broken line shown in FIG. 8(*b*)), for example. Then, the band synthesis unit 104 adds both the speech signals (FIG. 8(*c*)) to generate the restored speech signal (FIG. 8(*d*)).

Incidentally, although not shown, the configuration of FIG. 7 can be applied to the speech signal restoration device 200.

The weight adjusting units 301 and 302 can assign weights as needed such as using a constant weight in the direction of frequency or using weights with frequency characteristics that increase with the frequency. In addition, a configuration is also possible which comprises both the weight adjusting unit 301 and first bandpass filter 103, and causes the first bandpass filter 103 to extract the frequency band equal to the narrow-band speech signal from the wide-band speech signal that has passed through weight adjustment by the weight adjusting unit 301. Conversely, a configuration is also possible which causes the first bandpass filter 103 to extract the frequency band equal to the narrow-band speech signal from the wide-band speech signal, and causes the weight adjusting unit 301 to carry out the weight adjustment of the frequency band. Likewise, a configuration is possible which comprises both the weight adjusting unit 301 and second bandpass filter 202.

As described above, the speech signal restoration device in accordance with the present invention is configured in such a manner as to generate the restored speech signal from the wide-band speech signal, which is selected from the plurality of wide-band speech signals synthesized from the phoneme signals and sound source signals, and from the comparison target signal. Accordingly, it is suitable for an application for restoring the comparison target signal the frequency band of which is partially omitted because the frequency band is limited to a narrow band or is partially deteriorated or collapsed because of noise suppression or speech compression. Incidentally, when constructing the speech signal restoration device 100 or 200 from a computer, programs describing the processing contents of the sampling conversion unit 101, speech signal generating unit 102, restored speech signal generating unit 110, speech analysis unit 111, and noise suppression unit 201 can be stored in a computer memory, and the CPU of the computer can execute the programs stored in the memory.

INDUSTRIAL APPLICABILITY

A speech signal restoration device and speech signal restoration method in accordance with the present invention are configured in such a manner as to generate a plurality of speech signals by combining the phoneme signals and sound source signals, to estimate their waveform distortions with respect to the comparison target signal using a prescribed distortion scale, and to generate the restored speech signal by selecting any one of the speech signals on the basis of the evaluation result. Accordingly, it is suitable for an application for the speech signal restoration device and its method for restoring the wide-band speech signal from the speech signal whose frequency band is limited to the narrow band and for restoring the speech signal with a deteriorated or partially collapsed band.

What is claimed is:

1. A speech signal restoration device comprising:

a computer configured to generate a plurality of speech signals by combining phoneme signals and sound source signals, evaluate, using a prescribed distortion scale, a waveform distortion of each of the plurality of speech signals with respect to a comparison target signal having a frequency component of at least part of a frequency band of the speech signals the computer generates, and select one of the plurality of speech signals according to the evaluation result, and generate a restored speech signal using the speech signal selected.

2. The speech signal restoration device according to claim 1, wherein the computer further combines the comparison target signal with the speech signal selected.

3. The speech signal restoration device according to claim 1, wherein the computer evaluates a waveform distortion of a frequency component of a prescribed frequency band of each of the plurality of speech signals with respect to a frequency component of the prescribed frequency band of the comparison target signal.

4. The speech signal restoration device according to claim 3, wherein the computer is further configured to sample and convert the comparison target signal in a manner that the comparison target signal corresponds to the prescribed frequency band, and evaluates a waveform distortion of the frequency component of the prescribed frequency band of each of the plurality of speech signals with respect to the frequency component of the prescribed frequency band of the comparison target signal passing through the sampling conversion.

5. A speech signal restoration method comprising:

a synthesis filter step of generating a plurality of speech signals by combining phoneme signals and sound source signals;

a distortion evaluation step of evaluating, using a prescribed distortion scale, a waveform distortion of each of the plurality of speech signals the synthesis filter step generates with respect to a comparison target signal having a frequency component of at least part of a frequency band of the speech signals the synthesis filter step generates, and of selecting one of the plurality of speech signals according to the evaluation result; and a restored speech signal generating step of generating a restored speech signal using the speech signal the distortion evaluation step selects.

6. The speech signal restoration method according to claim 5, wherein the restored speech signal generating step comprises a band synthesis step for combining the comparison target signal with the speech signal the distortion evaluation step selects.

7. The speech signal restoration method according to claim 5, wherein the distortion evaluation step evaluates a waveform distortion of a frequency component of a prescribed frequency band of each of the plurality of speech signals the synthesis filter step generates with respect to a frequency component of the prescribed frequency band of the comparison target signal.

8. The speech signal restoration method according to claim 7, further comprising:

a sampling conversion step of sampling and converting the comparison target signal in a manner that the comparison target signal corresponds to the prescribed frequency band, wherein the distortion evaluation step evaluates a waveform distortion of the frequency component of the prescribed frequency band of each of the plurality of speech signals the synthesis filter step generates with respect to a frequency component of the prescribed frequency band of the comparison target signal passing through the sampling conversion of the sampling conversion step.

* * * * *